US011585147B2

(12) United States Patent
Mangat

(10) Patent No.: US 11,585,147 B2
(45) Date of Patent: Feb. 21, 2023

(54) SLIDABLE WINDOW CONSTRUCTION

(71) Applicant: Vision Profile Extrusions Limited, Woodbridge (CA)

(72) Inventor: Naseem Mangat, Woodbridge (CA)

(73) Assignee: Vision Profile Extrusions Limited, Woodbridge (CA)

( * ) Notice: Subject to any disclaimer, the term of this patent is extended or adjusted under 35 U.S.C. 154(b) by 214 days.

(21) Appl. No.: 16/777,806

(22) Filed: Jan. 30, 2020

(65) Prior Publication Data

US 2020/0240202 A1 Jul. 30, 2020

Related U.S. Application Data

(60) Provisional application No. 62/798,528, filed on Jan. 30, 2019.

(51) Int. Cl.
*E06B 3/46* (2006.01)
*E06B 3/42* (2006.01)

(52) U.S. Cl.
CPC ..... *E06B 3/4609* (2013.01); *E06B 3/42* (2013.01); *E05Y 2900/148* (2013.01)

(58) Field of Classification Search
CPC ..... E06B 3/5054; E06B 3/50; E06B 3/5072; E06B 3/4609; E06B 3/42; E05D 15/58; E05D 15/0604; E05D 2015/586
See application file for complete search history.

(56) References Cited

U.S. PATENT DOCUMENTS 2,515,537 A * 7/1950 Vaughn ..... E06B 3/5081 160/187
2,664,600 A * 1/1954 Smith ..... E06B 3/5063 49/456
2,846,733 A * 8/1958 Barsotti ..... E06B 3/50 49/178
2,920,358 A * 1/1960 Woodard ..... E06B 3/4609 49/365
3,041,680 A * 7/1962 Gurniak ..... E06B 3/5072 49/152
3,303,612 A * 2/1967 Baker ..... E05D 15/58 49/127
3,859,754 A 1/1975 Budich et al.
3,946,524 A 3/1976 Budich
(Continued)

*Primary Examiner* — Justin B Rephann
(74) *Attorney, Agent, or Firm* — Ridout & Maybee LLP

(57) ABSTRACT

There is provided a kit of parts configurable for assembly within a window assembly, that defines a window opening, and includes a frame and a sash, wherein the sash is slidably mounted relative to the frame for slidable movement relative to the frame from a first position to a second position, wherein the kit comprises a frame member of the above-described frame, a sash member of the above-described sash; wherein: the frame member defines a retainer; and the frame, the retainer, and the sash are co-operatively configured such that, while the sash is disposed relative to the frame in the first position, the retainer is interfering with movement of the sash member in an inwardly direction, and while the sash is disposed relative to the frame in the second position, there is an absence of interference to movement of the sash member in the inwardly direction. There is also provided a window construction obtainable from assembly of at least the parts of the kit of parts.

34 Claims, 14 Drawing Sheets

(56) References Cited

U.S. PATENT DOCUMENTS

| | | | | | |
|---|---|---|---|---|---|
| 4,226,050 | A | | 10/1980 | Kessler | |
| 4,569,154 | A | * | 2/1986 | Bayer | E05D 15/0604 49/161 |
| 5,272,839 | A | * | 12/1993 | Karhu | E05D 15/58 49/409 |
| 5,274,955 | A | * | 1/1994 | Dallaire | E06B 3/44 49/406 |
| 5,548,926 | A | * | 8/1996 | Sjoholm | E05D 15/58 49/127 |
| 5,749,172 | A | * | 5/1998 | Isopahkala | E05D 15/0604 49/124 |
| 6,415,565 | B1 | * | 7/2002 | Sosa | E05B 17/2065 292/4 |
| 8,756,865 | B2 | * | 6/2014 | Nicholson | E05D 15/58 49/180 |
| 2006/0059780 | A1 | * | 3/2006 | Petta | E06B 3/4609 49/163 |
| 2016/0251885 | A1 | * | 9/2016 | Conley | E05D 15/58 49/127 |

* cited by examiner

SLIDABLE WINDOW CONSTRUCTION

CROSS-REFERENCE TO RELATED APPLICATION

This application claims priority under 35 U.S.C. § 120 from U.S. Provisional Patent Application No. 62/798,528 filed on Jan. 30, 2019. The entire contents of the priority application is incorporated herein by reference.

FIELD

The present disclosure relate to window constructions.

BACKGROUND

Existing window constructions are defined by assemblies that include sashes, made of relatively flexible material, that are susceptible to deflection in response to excessive force applied by the wind. Such deflection, in some cases, defeats sealing engagement of the assembled components, thereby permitting flow of air between opposite sides of the window.

SUMMARY

In one aspect, there is provided a kit of parts configurable for assembly within a window assembly, that defines a window opening, and includes a frame and a sash, wherein the sash is slidably mounted relative to the frame for slidable movement relative to the frame from a first position to a second position, wherein the kit comprises: a frame member of the above-described frame, a sash member of the above-described sash; wherein: the frame member defines a retainer; and the frame, the retainer, and the sash are co-operatively configured such that, while the sash is disposed relative to the frame in the first position, the retainer is interfering with movement of the sash member in an inwardly direction, and while the sash is disposed relative to the frame in the second position, there is an absence of interference to movement of the sash member in the inwardly direction.

In another aspect, there is provided a window construction which defines a window opening, and includes a frame and a sash, wherein the sash is slidably mounted relative to the frame for slidable movement relative to the frame from a first position to a second position, wherein the window construction comprises: a frame and a sash; wherein: the frame defines a retainer; and the frame, the retainer, and the sash are co-operatively configured such that, while the sash is disposed relative to the frame in the first position, the retainer is interfering with movement of the sash in an inwardly direction, and while the sash is disposed relative to the frame in the second position, there is an absence of interference to movement of the sash member in the inwardly direction.

In another aspect there is provided a kit of parts configurable for assembly within a window assembly, that defines a window opening, and includes a frame and a sash, wherein the sash is slidably mounted relative to the frame for slidable movement relative to the frame from a first position to a second position, wherein the kit comprises: a frame member of the above-described frame, a sash member of the above-described sash; wherein: the frame member defines a retainer; and the frame, the retainer, and the sash are co-operatively configured such that, while the sash is disposed relative to the frame in the first position, the retainer is disposed such that: movement of the sash member in an inwardly direction relative to the frame member by a first distance is permitted; and movement of the sash member in an inwardly direction relative to the frame beyond the first distance is prevented, or substantially prevented, by interference, by the retainer, to movement of the sash member in the inwardly direction.

In another aspect, there is provided a kit of parts configurable for assembly within a window assembly, that defines a window opening, and includes a frame and a sash, wherein the sash is slidably mounted relative to the frame for slidable movement relative to the frame from a first position to a second position, wherein the kit comprises: a frame member of the above-described frame, a sash member of the above-described sash; wherein: the frame member defines a retainer; the sash member includes a retainable part; and the frame, the retainer, and the sash are co-operatively configured such that, while the sash is disposed relative to the frame in the first position, the retainable part and the retainer are cooperatively configured such that: the retainable part is aligned with the retainer along an axis transverse to a longitudinal axis of the sash member, such that movement of the sash relative to the frame in the inwardly direction by a first distance is effected by disposition of at least a portion of the retainable part underneath at least portion of the retainer; and movement of the sash relative to the frame in the inwardly direction by a distance greater than the first distance is prevented, or substantially prevented, by interference between at least a portion of the retainable part and the retainer such that opposition to movement of the sash is effected by the at least a portion of the retainable part acting against the retainer.

In another aspect, there is provided a window construction which defines a window opening, and includes a frame and a sash, wherein the sash is slidably mounted relative to the frame for slidable movement relative to the frame from a first position to a second position, wherein the window construction comprises: a frame, and a sash; wherein: the frame defines a retainer; and the frame, the retainer, and the sash are co-operatively configured such that, while the sash is disposed relative to the frame in the first position, the retainer is disposed such that: movement of the sash in an inwardly direction relative to the frame by a first distance is permitted; and movement of the sash in an inwardly direction relative to the frame by a distance greater than the first distance is prevented, or substantially prevented, by interference, by the retainer, to movement of the sash in the inwardly direction.

In another aspect, there is provided a window construction which defines a window opening, and includes a frame and a sash, wherein the sash is slidably mounted relative to the frame for slidable movement relative to the frame from a first position to a second position, wherein the window construction comprises: a frame, and a sash; wherein: the frame defines a retainer; the sash includes a retainable part; and the frame, the retainer, and the sash are cooperatively configured such that, while the sash is disposed relative to the frame in the first position, the retainable part and the retainer are cooperatively configured such that: the retainable part is aligned with the retainer along an axis transverse to a plane defined by a glass pane supported by the sash, such that: movement of the sash relative to the frame in the inwardly direction by a first distance is effected by disposition of at least a portion of the retainable part underneath at least portion of the retainer; and movement of the sash relative to the frame in the inwardly direction by a distance greater than the first distance is prevented, or substantially prevented, by interference between at least a portion of the retainable part and the retainer such that opposition to movement of the sash is effected by the at least a portion of the retainable part acting against the retainer.

BRIEF DESCRIPTION OF DRAWINGS

Reference will now be made, by way of example, to the accompanying drawings which show example embodiments of the present application, and in which.

DETAILED DESCRIPTION

Figure 2:
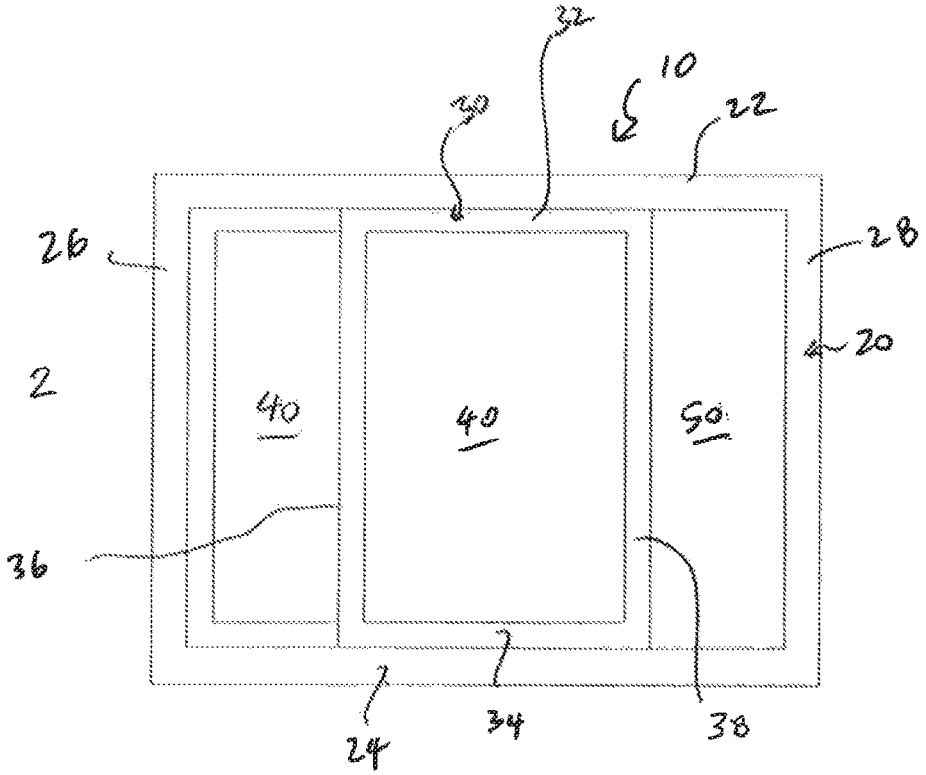
FIG. 2 is a front elevation view of the window assembly in FIG. 1, illustrating the window assembly in a partially open condition.
Figure 1:
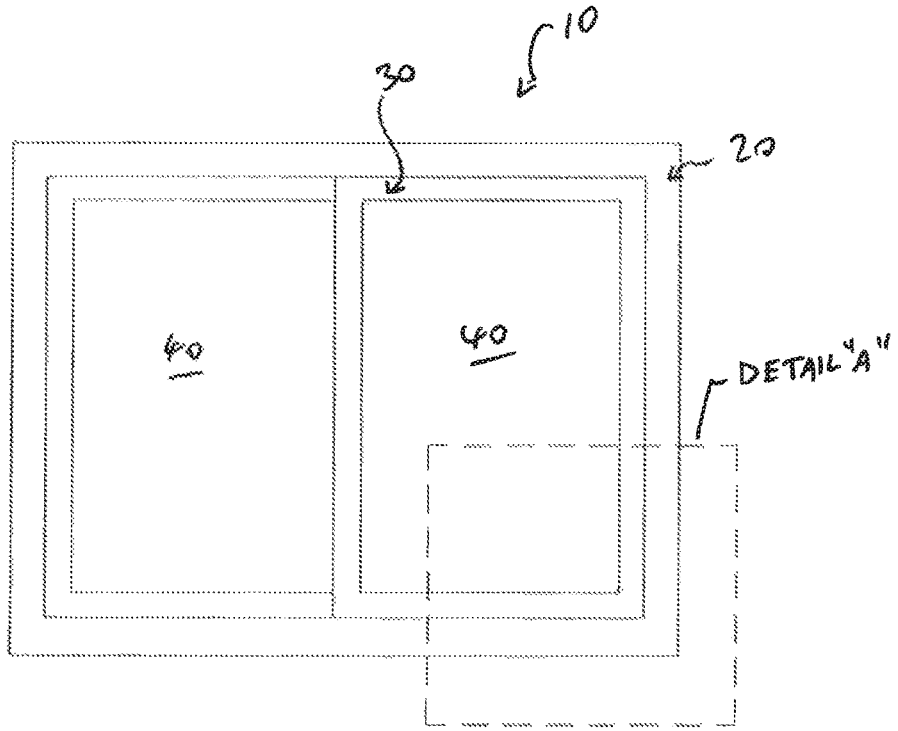
FIG. 1 is a front elevation view of a sliding window assembly, illustrating the window assembly in a closed condition.
Figure 3:
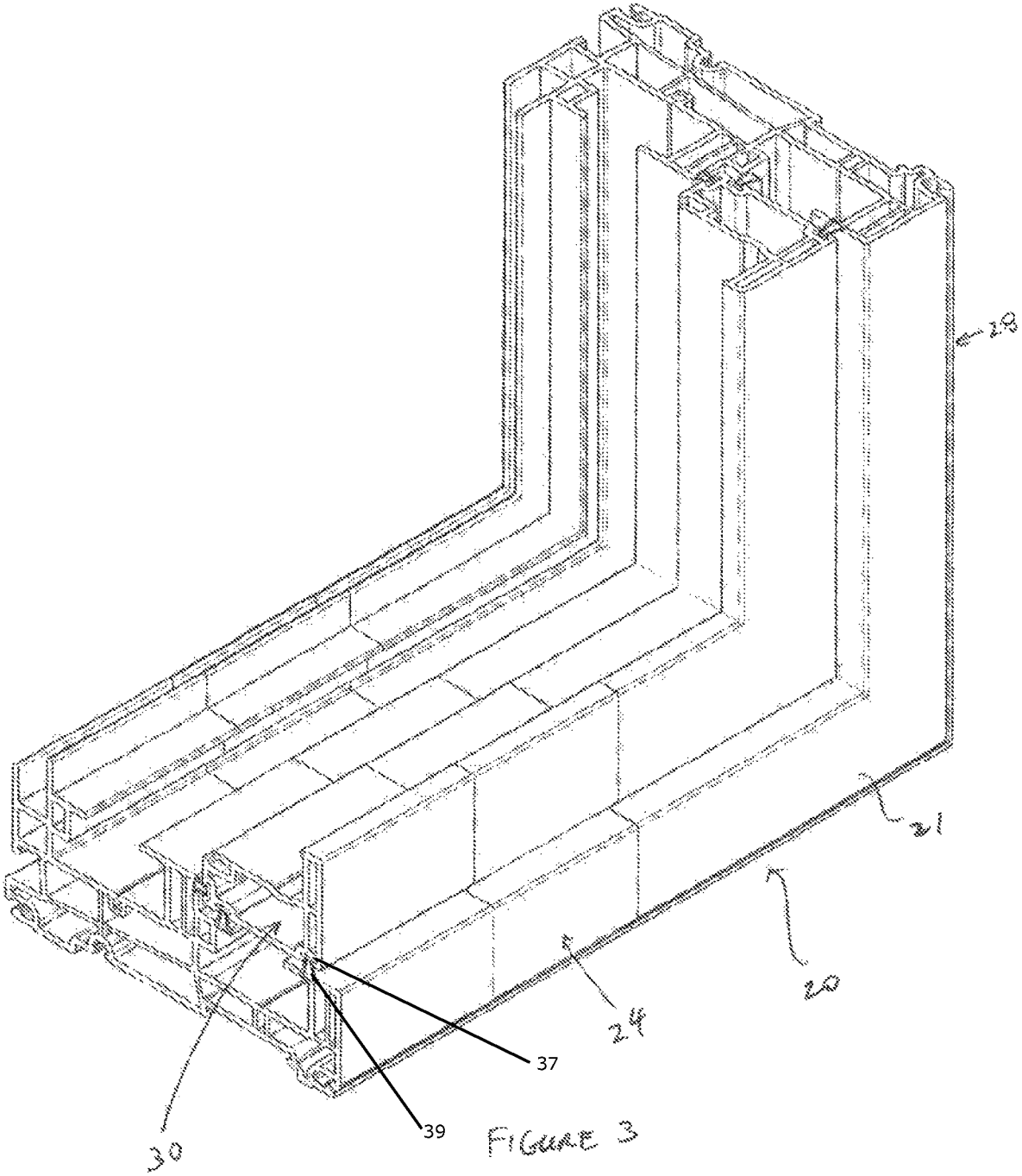
FIG. 3 is an enlarged view of Detail "A", in perspective from one side, in FIG. 1.

Referring to FIGS. 1 to 3, there is provided a window assembly 10, and a kit of parts of a window subassembly, wherein the parts of the kit are configurable for incorporation within the window assembly 10.

Exemplary window assemblies include those disclosed in U.S. Pat. Nos. 3,946,524, 3,859,754, and 4,226,050, and include windows whose sashes are configured for either one of horizontal and/or vertical displacement, including ones that are tiltable.

The window assembly includes a frame 20, a sash 30, and one or more glass panes 40, and the window assembly defines a window opening 50. The one or more glass panes 40 is supported by the sash 30.

In some embodiments, for example, the frame 20 includes upper and lower members 22, 24 and opposite side members 26, 28, and the upper member 22, lower member 24, side member 26, and side member 28 are co-operatively joined to define the frame.

In some embodiments, for example, the sash 30 includes upper and lower members 32, 34 and opposite side members 36, 38, and the upper member 32, lower member 34, side member 36, and side member 38 are co-operatively joined to define the sash 30. The one or more glass panes 40 (hereinafter, "the glass pane") are disposed between the upper and lower members 32, 34 and the opposite side members 36, 38.

The sash 30 is slidably mounted relative to the frame 20 for slidable movement relative to the frame 20 from a first position (see FIG. 1) to a second position (see FIG. 2). In some embodiments, for example, the slidable movement is within a horizontal plane. In some embodiments, for example, the slidable movement is within a vertical plane.

In some embodiments, for example, in the first position, the glass pane 40 is opposing a portion of the window opening 50, and in the second position, there is an absence of opposition of the widow opening portion by the glass pane 40. In some embodiments, for example, the first position is a closed position, and the second position is an open position. In the closed position, the window opening 50 is disposed in a closed condition, and in the open position, the window opening 50 is disposed in an open, or partially open, condition. In some embodiments, for example, in the closed position, air flow communication, via the window opening 50, between a first side and a second side of the window assembly 10 is sealed or substantially sealed, and in the open position, air flow communication, via the window opening 50, is established.

Where the window assembly 10 is a tiltable window, the slidable movement of the sash 30 is dictated by a balance shoe that is disposed within a balance pocket of the frame 20 and attached to the sash 30 via a pivot bar.

Figure 4:
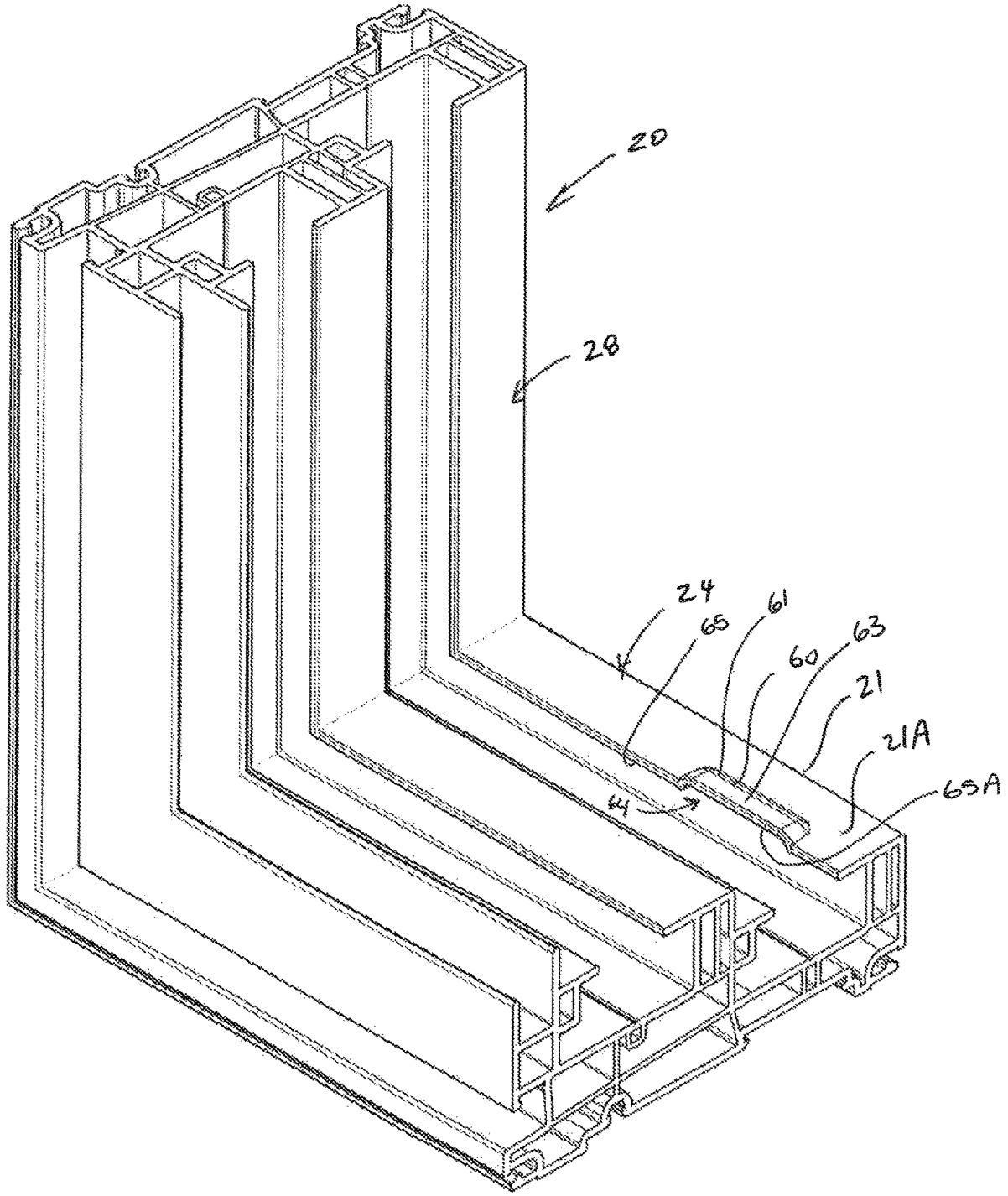
FIG. 4 is an enlarged view of Detail "A", in perspective from an opposite side to that of FIG. 3, with the sash removed for clarity.

Referring to FIG. 4, the window assembly 10 further includes a retainer 60.

In some embodiments, for example, the sash 30, the frame 20, and the retainer 60 are cooperatively configured such that, while the sash 30 is disposed relative to the frame 20 in the first position, the retainer 60 is interfering with movement (e.g. deflection) of the sash 30 in an inwardly direction (in response to, for example, force applied by wind), and while the sash 30 is disposed relative to the frame 20 in the second position, there is an absence of interference to movement of the sash 30 in the inwardly direction. In some embodiments, the absence of interference to movement is an absence of interference to movement by the retainer 60. In some embodiments, for example, the window assembly 10 is a tiltable window such that the sash 30 is rotatable relative to the frame 20, and in some of these embodiments, for example, the inwardly movement, to which there is an absence of interference, includes a rotational component.

In some embodiments, for example, the sash 30, the glass pane, the frame 20, and the retainer 60 are co-operatively configured such that, while the sash 30 is disposed relative to the frame 20 in the first position, the retainer 60 is interfering with movement (e.g. deflection) of the sash 30 in an operative direction that is transverse to a plane defined by the glass pane, and while the sash 30 is disposed relative to the frame 20 in the second position, there is an absence of interference to movement of the sash 30 in the operative direction. In some embodiments, the absence of interference to movement is an absence of interference to movement by the retainer 60. In some embodiments, for example, the window assembly 10 is a tiltable window such that the sash 30 is rotatable relative to the frame 20, and in some of these embodiments, for example, the movement in the operative direction, to which there is an absence of interference, includes a rotational component.

In some embodiments, for example, the sash 30, the frame 20, and the retainer 60 are cooperatively configured such that, while the sash 30 is disposed in the first position, the retainer 60 is disposed intermediate the ends of the sash 30, such as, for example, proximate the midpoint of the lower member of the sash 30.

In some embodiments, for example, the sash 30, the frame 20, and the retainer 60 are cooperatively configured such that, while the sash 30 is slidably moving relative to the frame 20, there is an absence, or substantial absence, of interference to the slidable movement by the retainer 60.

In some embodiments, for example, the retainer 60 includes a hard stop 61, the hard stop 61 limiting travel of the sash 30 within the frame 20 in the inwardly direction while the sash 30 is disposed in the first position or closed position. In some embodiments, for example, the hard stop 61 limits travel of the sash 30 within the frame 20 in the operative direction while the sash 30 is disposed in the first position or closed position.

In some embodiments, for example, the retainer 60 includes a protrusion 63 that is raised out of a plane defined by a surface of the frame 20. In some embodiments, for example, the protrusion 63 is a single longitudinally extending protrusion 63, extending from an upper surface 21A of the frame member 21. In some embodiments, for example, the longitudinally extending protrusion 63 is at least partly defined in an edge 65 of the upper surface 21A of the frame member 21 such that the longitudinally extending protrusion 63 defines a retainer end surface 65A, the longitudinally extending protrusion 63 defining an open end 64.

Figure 5:
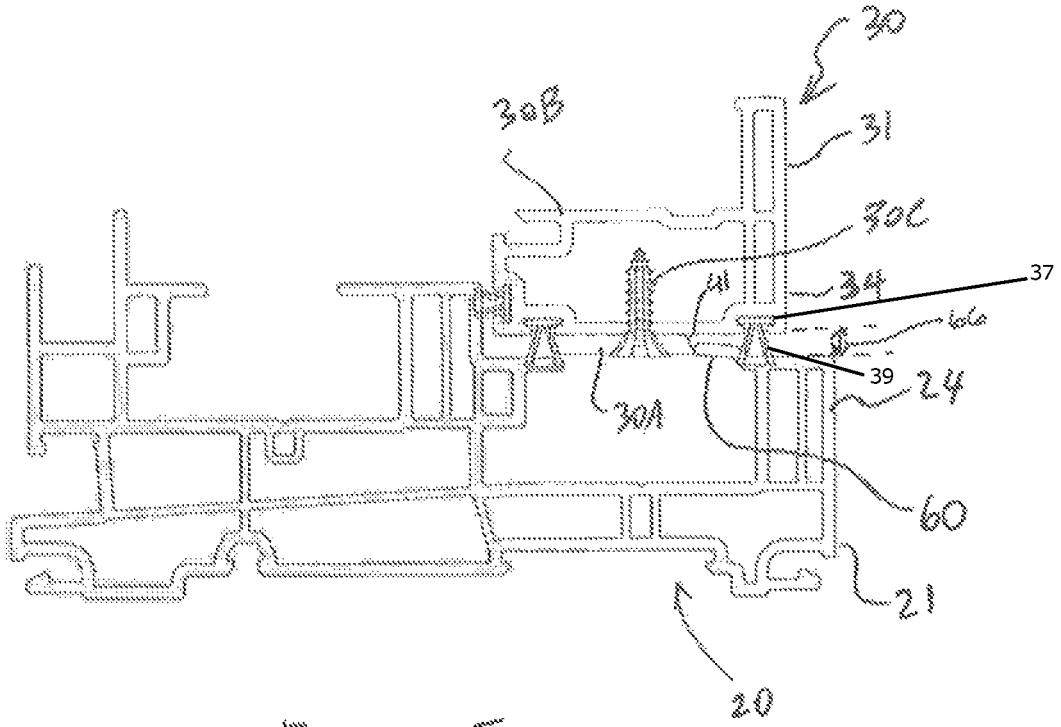
FIG. 5 is a side sectional view of an assembly of the lower member of the sash and the lower member of the frame, illustrating the retention of the sash by the retainer of the frame.
Figure 6:
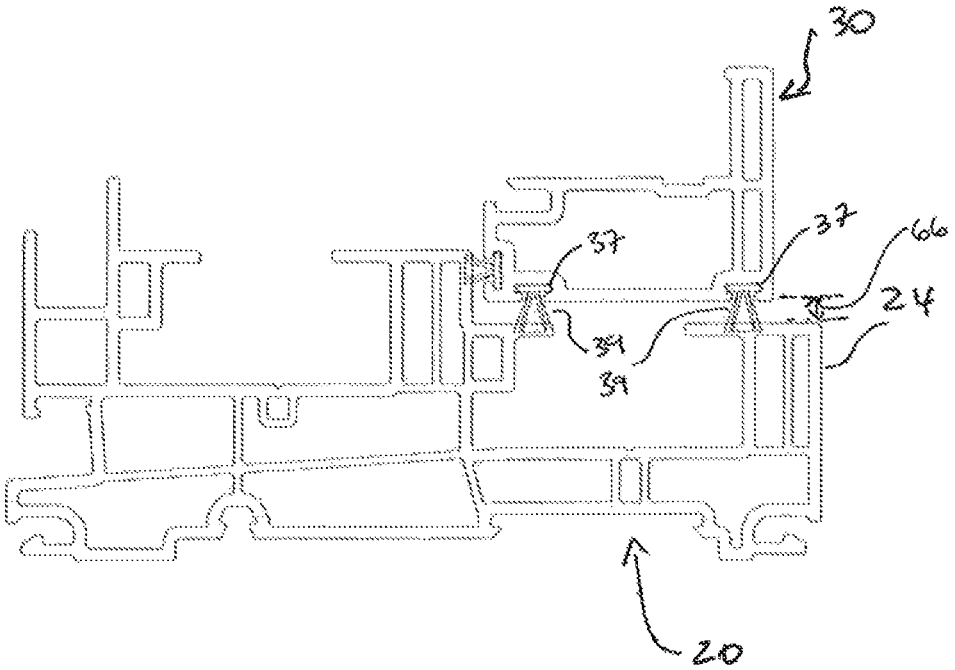
FIG. 6 is another side sectional view of an assembly of the lower member of the sash and the lower member of the frame, illustrating the absence of retention of the sash by the retainer.

Referring to FIG. 5, in some embodiments, for example, the interfering by the retainer 60 is effected in response to opposition to movement, by the retainer 60, of a retainable part 30A of the sash 30. In some embodiments, for example, the retainable part 30A includes an interfering member 33 such that the interfering by the retainer 60 is effected in response to opposition to movement, by the retainer 60, of the interfering member 33 of the sash 30.

In some embodiments, the opposition to movement of the sash 30 relative to the frame 20 in the inwardly or operative direction is effected by the interfering member 33 engaging the hard stop 61.

In some embodiments, for example, the interfering by the retainer 60 is effected in response to opposition to movement, by the retainer 60, effected by at least a portion of the retainable part 30A impinging against the retainer 60. In some embodiments, for example, the interfering by the retainer 60 is effected in response to opposition to movement, by the retainer 60, effected by at least a portion of the retainable part 30A impinging against the retainer end surface 65A.

In some embodiments, for example, impinging of the retainable part 30A against the retainer end surface 65A is such that the retainer 60 deflects such that at least a portion of the retainable part 30A is disposed at least partially underneath at least a portion of the retainer 30A. In some embodiments, for example, the retainable part 31A includes a sloped or angled leading edge 41 wherein the sloped or angled leading edge 41 is configured such that impinging of the leading edge 41 of the retainable portion 30A against the retainer end surface 65A, in response to movement of the sash 30 relative to the frame 20 in the inwardly direction (or operative direction) is such that the retainer 60 deflects upwardly along the angled leading edge 41 of the retainable part 30A such that at least a portion of the angled leading edge 41 of the retainable part 30A is disposed underneath at least a portion of the retainer 60.

Figure 7:
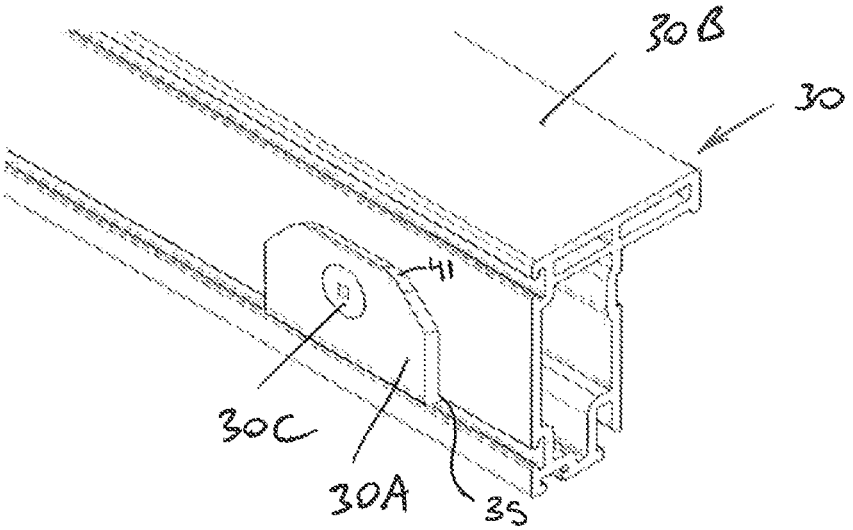
FIG. 7 is a fragmentary view, in perspective, of the retainable part fastened to the lower member of sash.
Figure 8:
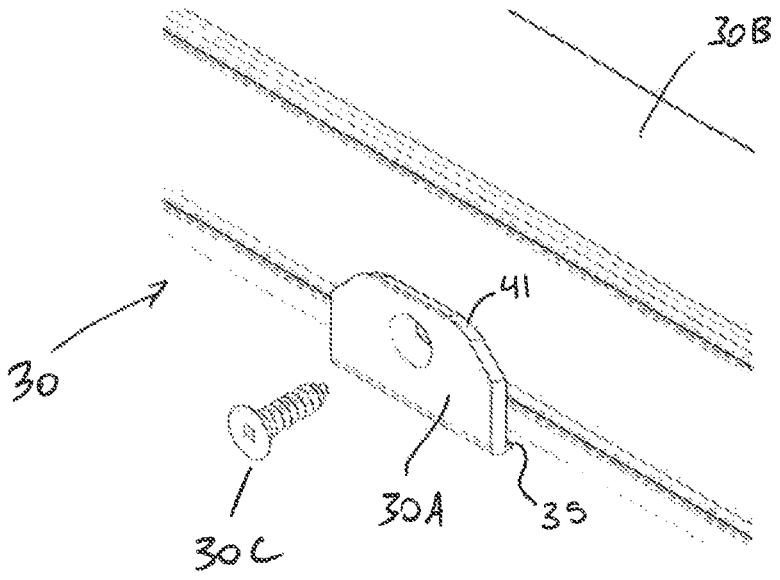
FIG. 8 is identical to FIG. 5, except the parts are in exploded format

Referring to FIGS. 7 and 8, in some embodiments, for example, the retainable part 30A is a separate component from the sash 30, and the sash 30 is defined by a sash assembly including a window-supporting part 30B and the retainable part 30A, and the retainable part 30A is fastened to the window-supporting part 30B. In this respect, the retainable part 30A is a component that is fastened to the window-supporting part 30B with one or more mechanical fasteners 30C, such as one or more screws. In other embodiments, for example, the retainable part 30A is defined by the sash 30.

In example embodiments wherein the retainable part 30A is a separate component from the sash 30, in some embodiments, for example, the retainable part 30A includes a locator 35 for positioning the retainable part 30A relative to the sash 30. In some embodiments, for example, the locator 35 facilitates the fastening of the retainable part 30A to the sash 30 via the one or more mechanical fasteners 30C by aligning corresponding fastener openings in the sash 30 and the retainable part 30A. In some embodiments, for example, the locator 35 includes a locating edge 35 configured for engaging against a corresponding edge portion 35A on the sash 30. In some embodiments, for example, the edge portion 35A is an edge of a groove 37 disposed within a bottom surface of the sash 30 on which the retainable part 30A is fastened. In some embodiments, for example, the groove 37 is configured for receiving weather stripping 39, the weather stripping 39 effecting sealing engagement, or substantial sealing engagement, with the frame 20.

In some embodiments, for example, the sash 30, the frame 20, and the retainer 60 are cooperatively configured such that the retainable part 30A of the sash 30 is supported by the frame 20 such that the retainable part 30A, or at least a portion of the retainable part 30A is disposed in contact engagement with the frame 20, or at least a portion of the frame 20, while the sash 30 is slidably moving across the frame 20. In this respect, there is overlap between the retainable part 30A of the sash 30 and the frame 20. This overlap allows the sash 30 to slidably move across the frame 20, while mitigating crushing of the weather-stripping 39 by the weight of the glass pane 40. Accordingly, in some embodiments, for example, the sash 30, the frame 20, and the retainable part 30A are cooperatively configured such that the retainable part 30A maintains a gap 66 between the sash 30 and the frame 20 to mitigate crushing of the weather stripping 39 by the weight of the glass pane disposed within and supported by the sash 30.

Figure 9:
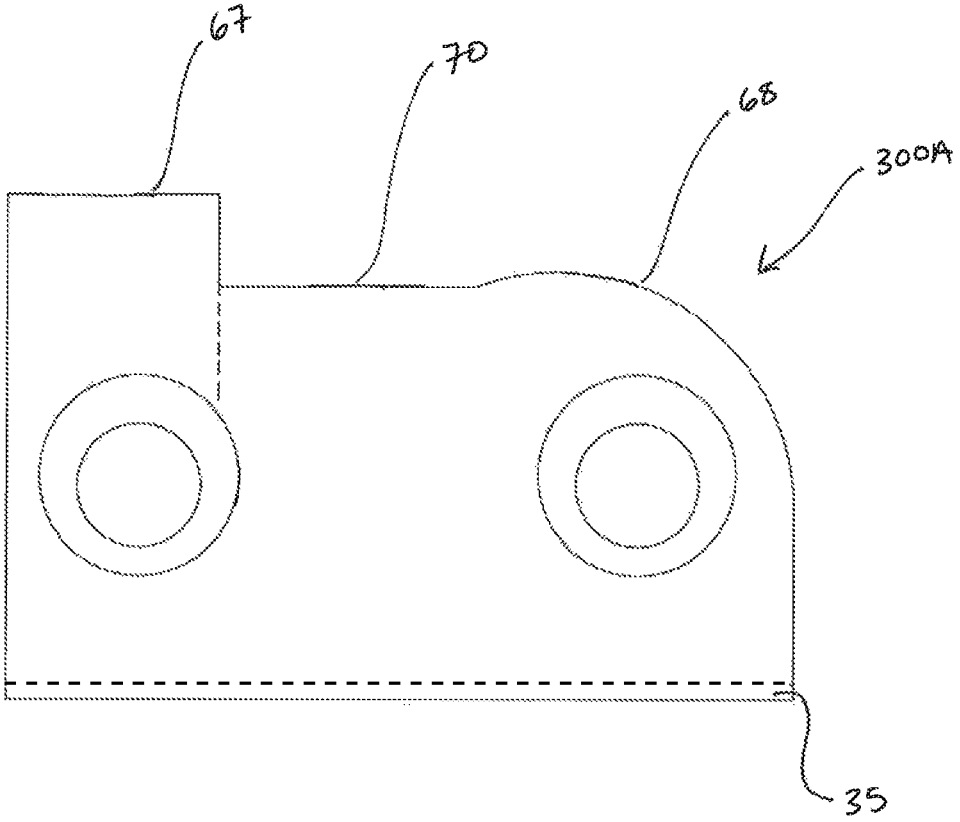
FIG. 9 is a bottom plan view of another example embodiment of a retainable part for fastening to the lower member of the sash.
Figure 10:
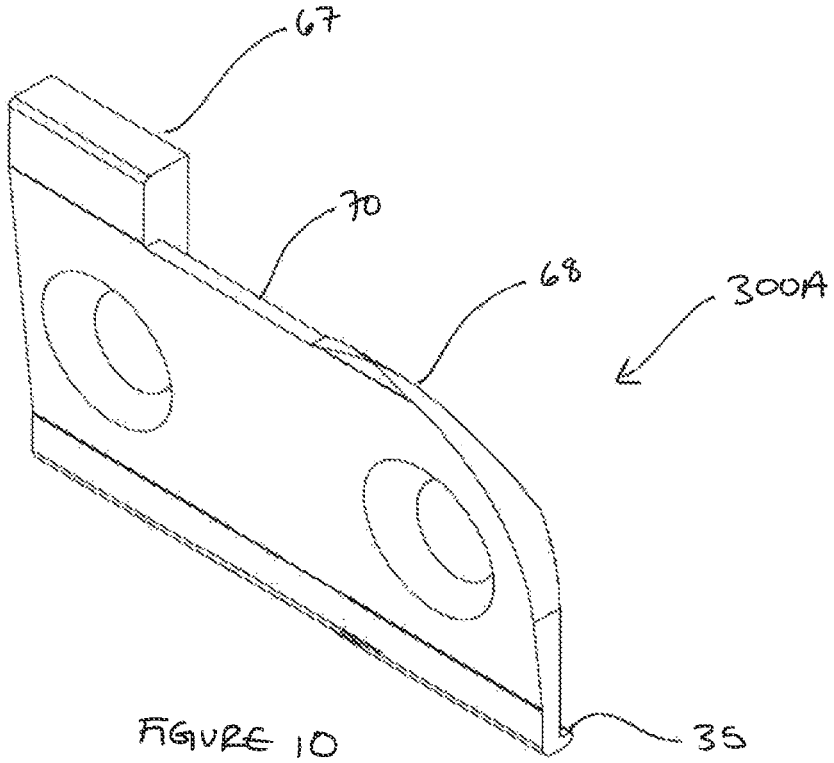
FIG. 10 is a bottom, perspective view of the retainable part of FIG. 9.
Figure 11:
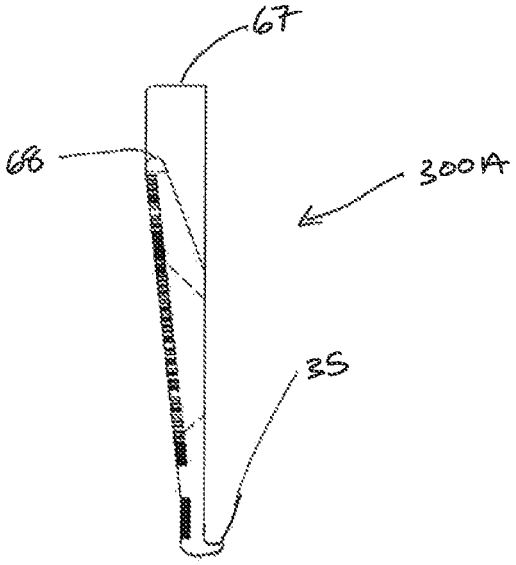
FIG. 11 is a right, end view of the retainable part of FIG. 9.
Figure 12:
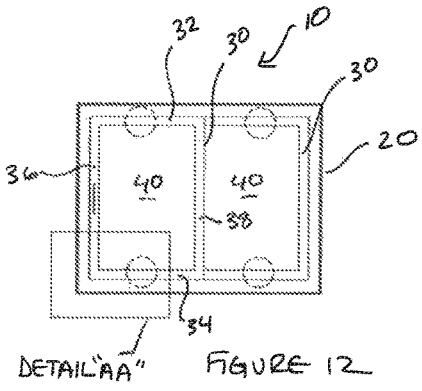
FIG. 12 is a front elevation view of a sliding window assembly according to another example embodiment of the present disclosure, illustrating the window assembly in a closed condition, incorporating the retainable part of FIG. 9.
Figure 13:
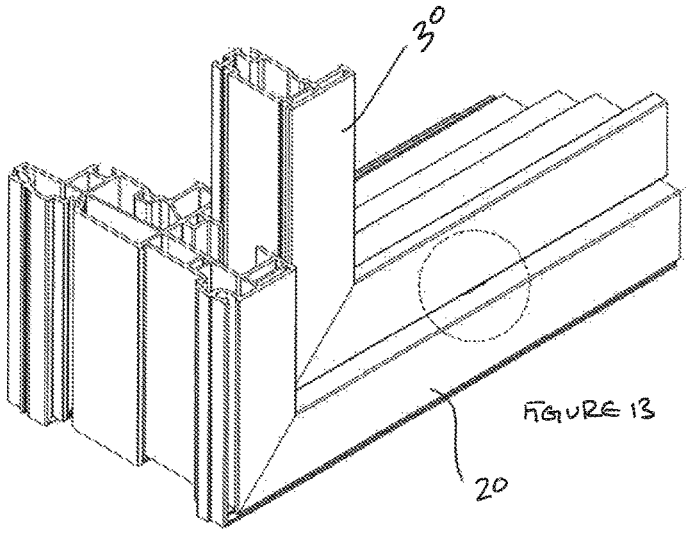
FIG. 13 is an enlarged perspective view of Detail AA in FIG. 12.
Figure 14:
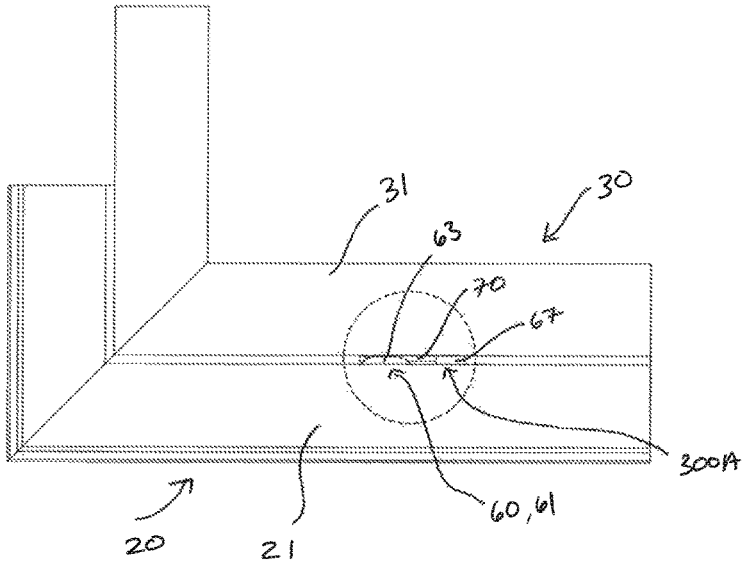
FIG. 14 is an enlarged front view of Detail AA in FIG. 12.
Figure 15:
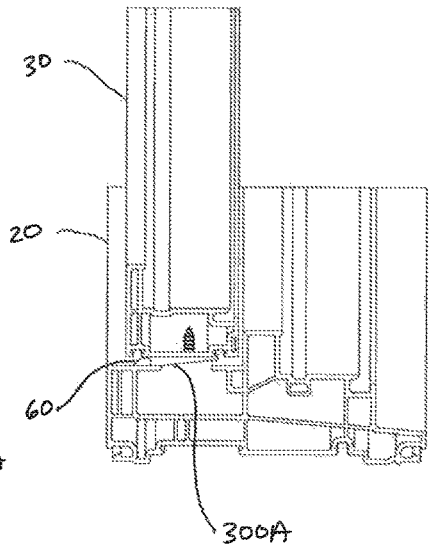
FIG. 15 is a sectional, end view of Detail AA of FIG. 14.
Figure 17:
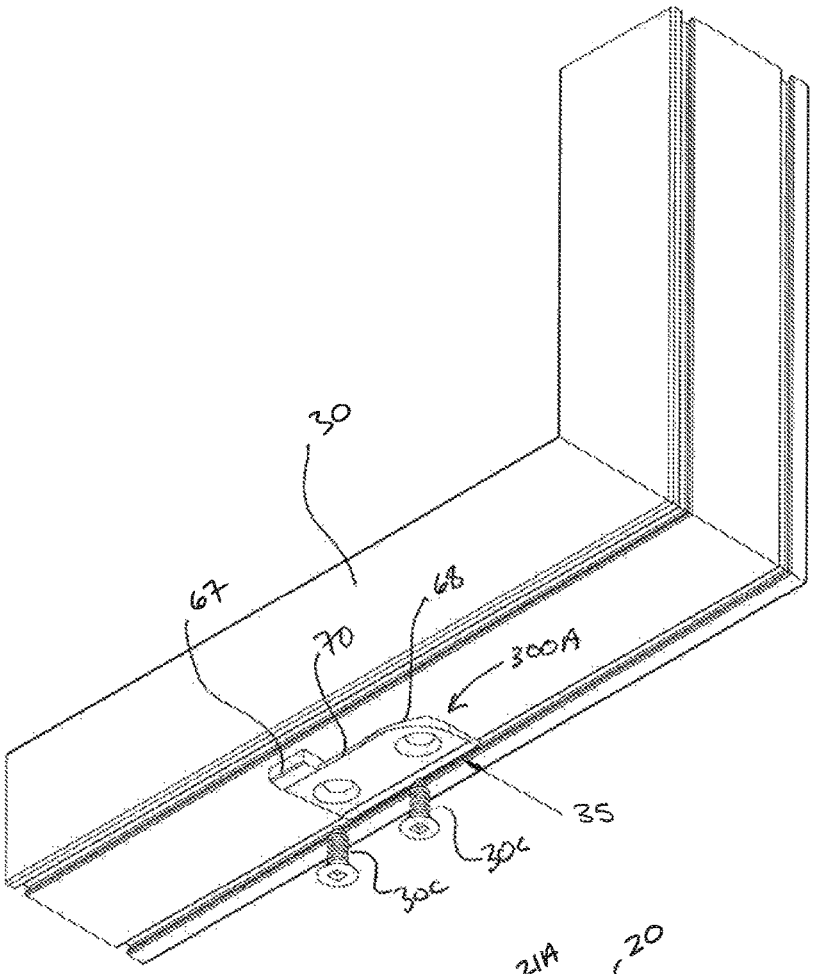
FIG. 17 is a bottom plan view of the retainable part of FIG. 9 fastening to the lower member of the sash.
Figure 16:
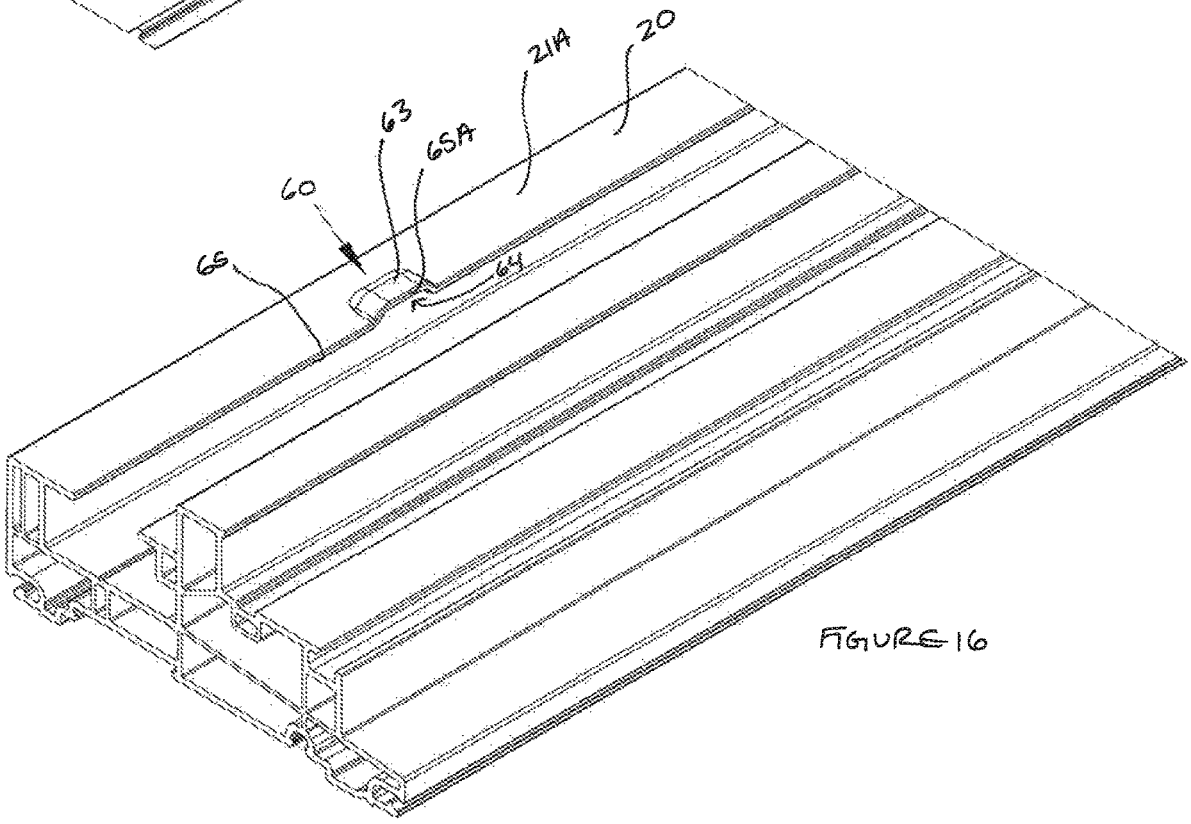
FIG. 16 is a fragmentary view, in perspective, of a portion of the lower member of the frame illustrating the retainer.
Figure 18:
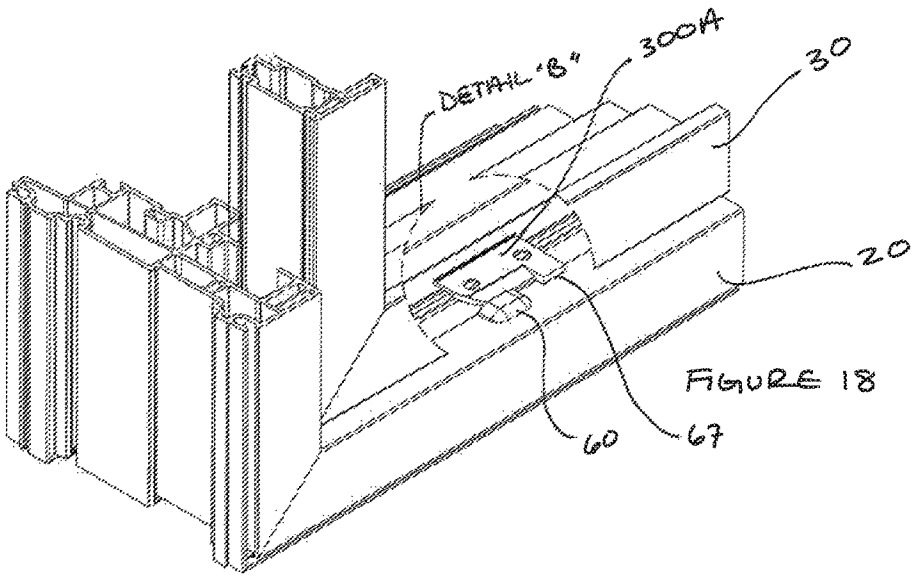
FIG. 18 is an enlarged, fragmentary, perspective view as shown in FIG. 13 with a portion of the sash removed, for ease of illustration, illustrating the first or closed position.
Figure 19:
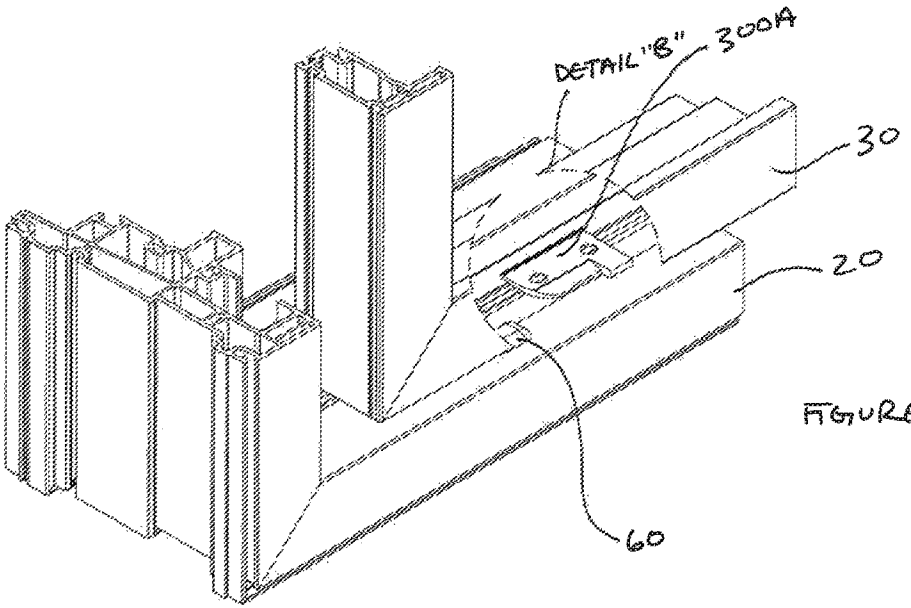
FIG. 19 is an enlarged, fragmentary, perspective view as shown in FIG. 13 with a portion of the sash removed, for ease of illustration, illustrating the second or open position.
Figure 18A:
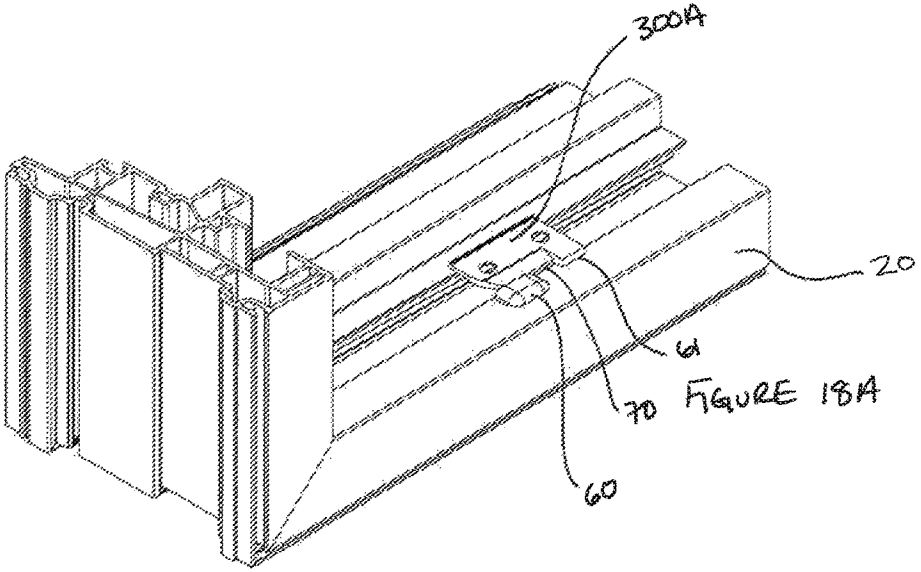
FIG. 18A is an enlarged, fragmentary, perspective view as shown in FIG. 13 with the sash removed, for ease of illustration, illustrating the first or closed position.
Figure 19A:
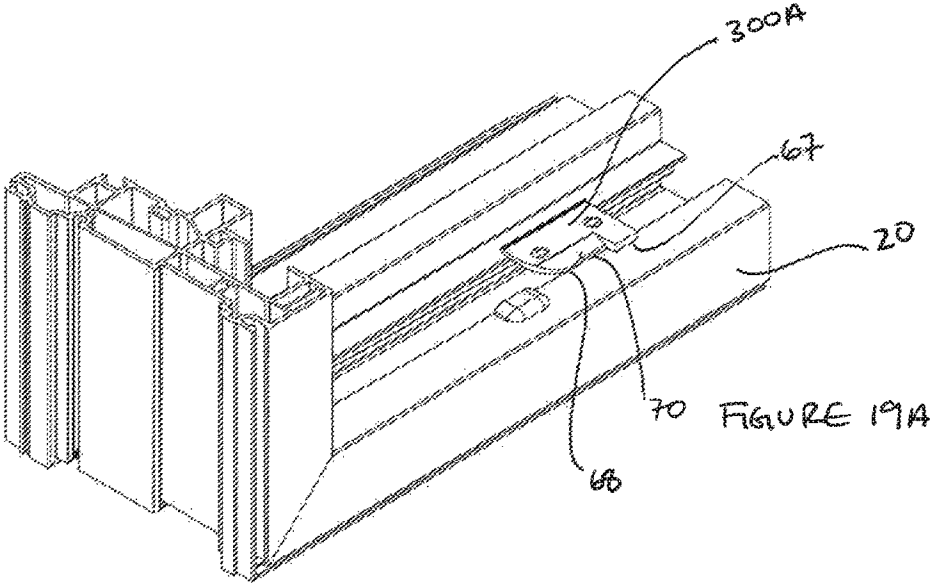
FIG. 19A is an enlarged, fragmentary, perspective view as shown in FIG. 13 with the sash removed, for ease of illustration, illustrating the second or open position.
Figure 22:
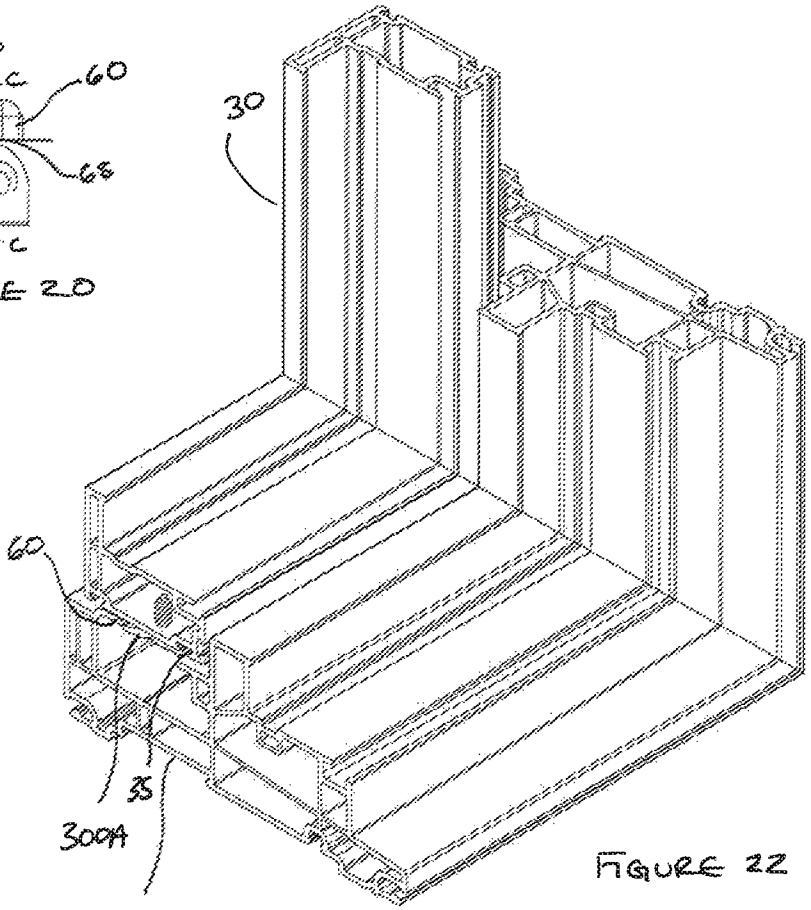
FIG. 22 is a perspective view of the cross-sectional view of FIG. 21.
Figure 20:
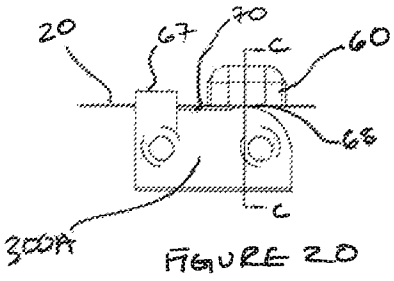
FIG. 20 is an enlarged, top view of the encircled area Detail B of FIG. 18.
Figure 21:
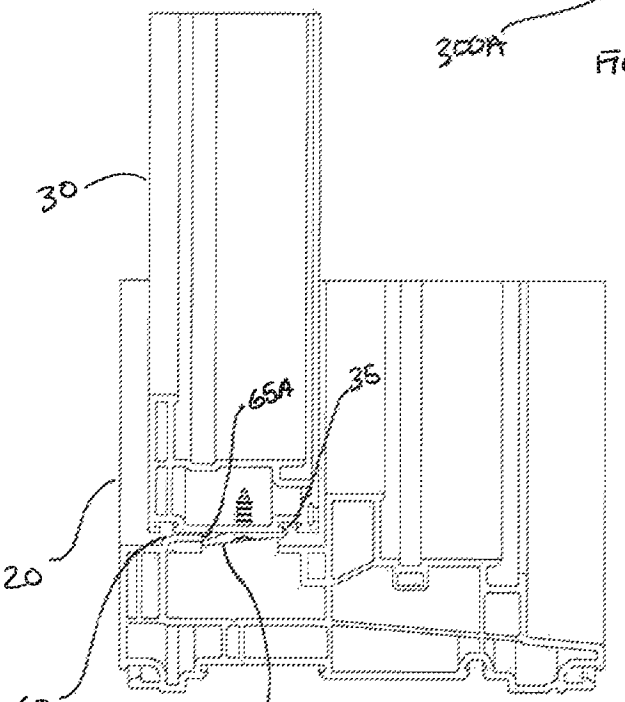
FIG. 21 is a cross-sectional view taken along section line C-C in FIG. 20.

Referring now to FIGS. 9-11 there is shown another example embodiment of a retainable part 300A for fastening to the sash 30. As shown, in some embodiments, the retainable part 300A includes a glider 67 configured for slidably supporting the sash 30 relative to the frame 20. Accordingly, in some embodiments, the retainable part 300A, the sash 30 and the frame 20 are cooperatively configured such that while the sash 30 is disposed in the first position, the gilder 67, or at least a portion of the glider 67, overlaps a portion of the frame 20 such that the sash 30 is supported on the frame 20 (to mitigate crushing of the weather-stripping 39), the glider configured for sliding engagement along the frame 20 as the sash 30 slides along the frame 20 while being disposed from the first position to the second, open position.

In some embodiments, for example, the retainable part 300A includes a protrusion portion 68, the protrusion portion 68 defining a portion of the front or leading edge 41 of the retainable part 300A. In some embodiments, for example, the protrusion portion 68 includes a wedge lock.

Accordingly, in some embodiments, while the sash 30 is disposed relative to the frame 20 in the first or closed position, the retainable part 300A is disposed relative to the frame 20 such that at least a portion of the retainable part 300A is disposed in alignment with the retainer 60 along an axis transverse to the plane defined by the glass pane 40 such that, while the sash 30 is disposed in the closed position and the sash 30 and/or glass pane 40 is subject to a force applied in the inwardly (or operative) direction, for example a force applied by wind, and the sash 30 is displaced in the inwardly direction (or operative direction), the protrusion portion 68, or at least a portion of the protrusion portion 68, of the retainable part 300A becomes disposed underneath the retainer 60. In some embodiments, for example, at least a portion of the protrusion portion 68, of the retainable part 300A becomes disposed within the open end 64 of the retainer 60.

In some embodiments, for example, the retainable part 300A includes a displacement limiter 70 for limiting displacement of the sash 30 relative to the frame 20. Accordingly, in some embodiments, the displacement limiter 70 is a hard stop for preventing further displacement of the sash 30 relative to the frame 20 in response to application of additional force applied to the sash 30 (or glass pane 40) in the inward direction (or operative direction) subsequent to an initial force applied to the sash 30 (or glass pane 40) that effects an initial, permissible displacement of the sash 30 relative to the frame 20.

Accordingly, in some embodiments, the retainer 60 and the retainable part 300A are cooperatively configured such that, while the sash 30 is disposed relative to the frame 20 in the first or closed position, the retainable part 300A is disposed in alignment with the retainer 60 such that the protrusion portion 68 of the retainable part 300A is disposed in alignment with a gap defined by the retainer 60 such that application of a force in the inwardly direction, or operative direction effects displacement of the sash 30 relative to the frame 20 such that the protrusion portion 68 is disposed underneath at least a portion of the retainer 60 until the displacement limiter 70 is brought into contact with, or impinges against at least a portion of the retainer 60. In some embodiments, for example, the displacement limiter 70 impinges against the front edge 65A of the retainer 60 which impedes any further displacement or deflection of the sash 30 relative to the frame 20 in the inward or operative direction.

In some embodiments, for example, where the window assembly 10 is a tiltable window, such that the sash 30 can pivot relative to the frame 20, the retainable part 30A, 300A and the retainer 60 are cooperatively configured such that while the sash 30 is disposed relative to the frame 20 in the first or closed position, and the sash 30 pivots relative to the frame 20 for effecting disposition of the sash is a third position such as a tilted, open position, there is an absence of interference between the retainable part 30A, 300A and the retainer 60 as the sash 30 pivots relative to the frame 20. Accordingly, in some embodiments, the retainable part 60 includes a curved edge for ensuring clearance between the sash 30 and the retainer 60 while the sash 30 pivots relative to the frame 20 such that the sash 30 becomes disposed in an open, tilted position or third position.

In some embodiments, for example, the window assembly 10 is assembled from a plurality of parts. In some of these embodiments, for example, the plurality of parts includes parts for a window subassembly of the above-mentioned kit. In this respect, the kit is not necessarily comprising of all of the parts of the window assembly 10, and, in some embodiments, is comprising only some of the parts of the window assembly 10. In some embodiments, for example, at least some of the parts of the window subassembly are formed by an extrusion process. In this respect, in some embodiments, for example, at least some of the parts of the window subassembly are defined by extruded parts, such as, for example, plastic extruded parts. In this respect, at least some of the parts of the window assembly 10 are defined by extruded parts, such as, for example, plastic extruded parts.

Referring to FIGS. 3 to 8, the parts for a window subassembly include a frame member 22 of the above-described frame 20, and a sash member 31 of the above-described sash 30. In some embodiments, for example, the frame member 21 defines the lower member 24 of the frame 20, and the sash member 31 defines the lower member 34 of the sash.

The parts of the window subassembly further includes the retainer 60. In some of these embodiments, for example, the retainer 60 is defined by the frame member 22. In some embodiments, for example, the retainer 60 includes a protrusion, such as, for example, a single longitudinally extending protrusion 63, extending from an upper surface 21A of the frame member 21.

In some embodiments, for example, the parts of the window subassembly are configurable for assembly with one or more other parts for defining the above-described window assembly 10. In this respect, in some embodiments, for example, the parts of the window subassembly are configurable for assembly within the above-described window assembly 10.

Referring specifically to FIG. 4, in some of these embodiments, for example, the sash 30, the frame 20, and the retainer 60 are co-operatively configured such that, while the sash 30 is disposed relative to the frame 20 in the first position, the retainer 60 is interfering with movement (e.g. deflection) of the sash member 31 (of the window subassembly) in an inwardly direction, and while the sash 30 is disposed relative to the frame 20 in the second position, there is an absence of interference to movement of the sash member 31 in the inwardly direction. In some embodiments, the absence of interference to movement is an absence of interference to movement by the retainer 60. In some embodiments, for example, the window assembly 10 is a tiltable window such that the sash member 31 is rotatable relative to the frame 20, and in some of these embodiments, for example, the inwardly movement, to which there is an absence of interference, includes a rotational component.

In some of these embodiments, for example, the sash 30, the glass pane 40, the retainer 60, and the frame 20 are co-operatively configured such that, while the sash 30 is disposed relative to the frame 20 in the first position, the retainer 60 is interfering with movement (e.g. deflection) of the sash member 30 (of the window subassembly) in an operative direction that is transverse to a plane defined by the glass pane 40, and while the sash 30 is disposed relative to the frame 20 in the second position, there is an absence of interference to movement of the sash member 31 in the operative direction. In some embodiments, the absence of interference to movement is an absence of interference to movement by the retainer 60. In some embodiments, for example, the window assembly 10 is a tiltable window such that the sash member 31 is rotatable relative to the frame 20, and in some of these embodiments, for example, the movement in the operative direction, to which there is an absence of interference, includes a rotational component.

In some embodiments, for example, the sash 30, the frame 20, and the retainer 60 are cooperatively configured such that, while the sash 30 is disposed in the first position, the retainer 60 is disposed intermediate the ends of the sash member 31, such as, for example, proximate the midpoint of the sash member 31.

In some embodiments, for example, the sash 30, the frame 20, and the retainer 60 are cooperatively configured such that, while the sash 30 member is slidably moving relative to the frame 20, there is an absence, or substantial absence, of interference to the slidable movement by the retainer 60.

In some embodiments, for example, the interfering by the retainer 60 is effected in response to opposition to movement, by the retainer 60, of a retainable part 30A, 300A that is fastened to the sash 30 member with one or more mechanical fasteners, such as one or more screws. In this respect, the kit further includes the retainable part 30A, 300A. In some embodiments, for example, the retainable part 30A, 300A is metallic. In some embodiments, for example, the retainable part 30A, 300A includes a locator 35 for aligning and/or locating the retainable part 30A, 300A relative to the sash 30. In some embodiments, for example, the retainable part 300A includes a glider 67 configured for sliding engagement with the frame 20, the glider 67 slidably engaging the frame 20 in response to sliding movement of the sash 30 relative to the frame 20.

In some embodiments, the retainable part 300A is configured such that while the sash 30 is disposed within the frame 20 and disposed in the first position such that the retainable part 300A is aligned with the retainer 60 along an axis transverse to the plane of the glass pane 40, deflection or movement of the sash 30 relative to the frame 20 in the inward direction or the operative direction of a first distance mount is permitted, while deflection or movement of the sash 30 relative to the frame 20 in the inward direction or the operative direction of an amount or distance greater than the first amount is prevented, or substantially prevented. Accordingly, in some embodiments, the retainable part 300A includes a limiter or displacement limiter 70, such that engagement of the limiter 70 with at least a portion of the retainer 60 prevents, or substantially prevents, deflection or movement of the sash 30 relative to the frame 20 in the inward direction or the operative direction by a distance greater than an initial, permissible deflection or degree of movement. Accordingly, in some embodiments, the retainable part 300A includes a protrusion portion 68 configured to be received underneath the retainer 60 in response to application of a force to the sash 30 in the inward or operative direction such that an initial deflection or an initial degree of movement or displacement of the sash 30 relative to the frame 20 is permissible until the limiter 70 impinges against the retainer 60 preventing, or substantially preventing, further deflection or movement of the sash 30 relative to the frame 20 while the sash 30 is disposed in the closed or first position.

In some embodiments, for example, where the window assembly 10 is a tiltable window, such that the sash 30 can pivot relative to the frame 20, the retainable part 30A, 300A and the retainer 60 are cooperatively configured such that while the sash 30 is disposed relative to the frame 20 in the first or closed position, and the sash 30 pivots relative to the frame 20 for effecting disposition of the sash is a third position such as a tilted, open position, there is an absence of interference between the retainable part 30A, 300A and the retainer 60 as the sash 30 pivots relative to the frame 20. Accordingly, in some embodiments, the retainable part 60 includes a curved edge for ensuring clearance between the sash 30 and the retainer 60 while the sash 30 pivots relative to the frame 20 such that the sash 30 becomes disposed in an open, tilted position or third position.

The embodiments of the present disclosure described above are intended to be examples only. The present disclosure may be embodied in other specific forms. Alterations, modifications and variations to the disclosure may be made without departing from the intended scope of the present disclosure. While the system, devices and processes disclosed and shown herein may comprise a specific number of elements/components, the systems, devices and assemblies could be modified to include addition or fewer of such elements/components. For example, while any of the elements/components disclosed may be referenced as being singular, the embodiments disclosed herein could be modified to include a plurality of such elements/components. Selected features from one or more of the above-described embodiments may be combined to create alternative embodiments not explicitly described. All values and subranges within disclosed ranges are also disclosed. The subject matter described herein intends to cover and embrace all suitable changes in technology. All references mentioned are hereby incorporated by reference in their entirety.

The invention claimed is:

1. A kit of parts configurable for assembly within a window assembly, that defines a window opening, and includes a frame and a sash, wherein the sash is slidably mounted relative to the frame for slidable movement relative to the frame, wherein the kit comprises:

a frame member of the frame, a sash member of the sash; and a frame-cooperating member configured for coupling to the sash member;

wherein the frame member defines a planar surface and a retainer, wherein the retainer projects above the planar surface;

the sash member defines a sealing member receiver configured for coupling with a sealing member; and the frame member, the sash member, and the frame-cooperating member are co-operatively configured such that, while the frame co-operating member is coupled to the sash member and the sealing member is coupled to the sash member via the sealing member receiver, and while the sash is slidable relative to the frame between a first position, wherein the sash member is disposed relative to the frame such that the retainer and the frame co-operating member are disposed in alignment along an axis that extends transverse to a plane of a pane of glass that is supported by the sash such that the retainer interferes with deflection of the sash member relative to the frame member in an inwardly direction by opposition to movement of the frame-cooperating member, and a second position, wherein the sash member is disposed relative to the frame such that there is an absence of interference to movement of the sash member, by the retainer, in the inwardly direction:

the frame-cooperating member is disposed in contact engagement with the frame member such that the sash member is elevated above the planar surface by the frame-cooperating member with effect that a gap is defined between the sash member and the planar surface; and the sealing member is emplaced within the gap defined between the sash member and the frame member with effect that the sealing member is disposed in contact engagement with the planar surface.

2. The kit as claimed in claim 1;

wherein:

the sash is rotatable relative to the frame; and while the sash is disposed relative to the frame in the second position, the inwardly movement of the sash relative to frame, to which there is an absence of interference, includes a rotational component.

3. The kit as claimed in claim 1;

wherein:

the retainer projects from the planar surface proximate a midpoint of the frame; and the frame member, the sash member, and the frame-cooperating member are cooperatively configured such that while the sash is disposed relative to the frame in the first position, the opposition to movement of the frame-cooperating member by the retainer occurs proximate a midpoint of the sash member.

4. The kit as claimed in claim 1;

wherein:

the sash member, the frame member, and the frame-cooperating member are co-operatively configured such that, while the sash is slidably moving relative to the frame, there is an absence, or substantial absence, of interference to the slidable movement of the sash by the retainer.

5. The kit as claimed in claim 1;

wherein:

the frame co-operating member is coupled to the sash member by a fastener.

6. The kit as claimed in claim 1;

wherein:

the sash member is defined by an extrusion.

7. The kit as claimed in claim 1;

wherein:

the frame member is defined by an extrusion.

8. The kit as claimed in claim 1;

wherein:

the frame-cooperating member and the retainer are cooperatively configured such that while the frame co-operating member is coupled to the sash member and the sash is disposed within the frame and disposed in the first position:

deflection of the sash relative to the frame in the inwardly direction by a first distance is permitted, or substantially permitted, while deflection of the sash relative to the frame in the inwardly direction by a distance greater than the first distance is prevented, or substantially prevented, by interference between the frame-cooperating member and the retainer.

9. The kit as claimed in claim 8;

wherein:

the interference between the frame-cooperating member and the retainer is such that at least a portion of the frame-cooperating member impinges against at least a portion of the retainer.

10. The kit as claimed in claim 8;

wherein the frame-cooperating member includes:

a protrusion portion; and a limiter;

wherein:

the deflection of the sash member relative to the frame member in the inwardly direction by the first amount is such that at least a portion of the protrusion portion is disposed underneath at least a portion of the retainer; and the interference, between the frame-cooperating member and the retainer, to movement of the sash member relative to the frame member in the inwardly direction is effected by disposition of the frame-cooperating member relative to the retainer such that the limiter impinges against at least a portion of the retainer.

11. The kit as claimed in claim 10;

wherein:

the frame-cooperating member further comprises a glider; and the frame member, the sash member, and the frame-cooperating member are cooperatively configured such that while the frame co-operating member is coupled to the sash member and the sash is disposed within the frame for slidable movement relative to the frame, the frame-cooperating member and the retainer are cooperatively configured such that:

the glider is disposed in contact engagement with the planar surface of the frame member;

while the sash is disposed relative to the frame in the first position, the glider is disposed adjacent to the retainer along a longitudinal axis of the frame member, and sliding movement of the sash relative to the frame from the first to the second position is effected, in part, by sliding movement of the glider along the planar surface of the frame member.

12. The kit as claimed in claim 1, wherein:

the sealing member includes weather stripping.

13. The kit as claimed in claim 1, wherein:

the contact engagement between the sealing member and the planar surface is effective for establishing a weather-tight seal between the sash member and the frame member.

14. The kit as claimed in claim 1, wherein:

the sealing member receiver is a groove extending along the sash member.

15. The kit as claimed in claim 1, wherein:

the slidable movement of the sash, relative to the frame, from the first position to the second position is with effect that the alignment is defeated.

16. A kit of parts configurable for assembly within a window assembly, that defines a window opening, and includes a frame and a sash, wherein the sash is slidably mounted relative to the frame for slidable movement relative to the frame, wherein the kit comprises:

a frame member of the frame, a sash member of the sash; and a frame-cooperating member configured for coupling to the sash member;

wherein:

the frame member defines a planar surface and a retainer, wherein the retainer projects above the planar surface;

the sash member defines a sealing member receiver configured for coupling with a sealing member; and the frame member, the sash member, and the frame-cooperating member are co-operatively configured such that, while the frame co-operating member is coupled to the sash member and the sealing member is coupled to the sash member via the sealing member receiver, and while the sash is slidable relative to the frame between a first position, wherein the sash member is disposed relative to the frame such that the retainer and the frame-cooperating member are disposed in alignment along an axis that extends transverse to a plane of a pane of glass that is supported by the sash such that the retainer interferes with movement of the sash member relative to the frame member in an inwardly direction by opposition to movement of the frame-cooperating member with effect that movement of the sash member in an inwardly direction relative to the frame member by a first distance is permitted, and movement of the sash member in the inwardly direction relative to the frame by a distance that is greater than the first distance is prevented, or substantially prevented, by interference, by the retainer, to movement of the sash member in the inwardly direction by opposition movement of the frame co-operating member by the retainer, and a second position, wherein the sash member is disposed relative to the frame such that there is an absence of interference to movement of the sash member, by the retainer, in the inwardly direction:

the frame co-operating member is disposed in contact engagement with the frame member such that the sash member is elevated above the planar surface by the frame co-operating member with effect that a gap is defined between the sash member and the planar surface; and the sealing member is emplaced within the gap defined between the sash member and the frame member with effect that the sealing member is disposed in contact engagement with the planar surface.

17. The kit of parts as claimed in claim 16;

wherein:

the sash is tiltably mounted relative to the frame such that the sash is disposed for pivoting movement relative to the frame from the first position to a third, open position; and the frame member, the sash member, and the frame co-operating member are co-operatively configured such that while the frame co-operating member is coupled to the sash member and the sash is disposed relative to the frame and is disposed in the first position, the retainer and the frame co-operating member are co-operatively configured such that there is an absence of interference to pivoting movement of the sash relative to the frame, by the retainer and the frame co-operating member, such that the sash becomes disposed in the third position.

18. The kit as claimed in claim 16;

wherein:

the frame co-operating member is coupled to the sash member by a fastener.

19. The kit as claimed in claim 16, wherein:

the sealing member includes weather stripping.

20. The kit as claimed in claim 16, wherein:

the contact engagement between the sealing member and the planar surface is effective for establishing a weather-tight seal between the sash member and the frame member.

21. The kit as claimed in claim 16, wherein:

the sealing member receiver is a groove extending along the sash member.

22. A kit of parts configurable for assembly within a window assembly, that defines a window opening, and includes a frame and a sash, wherein the sash is slidably mounted relative to the frame for slidable movement relative to the frame, wherein the kit comprises:

a frame member of the frame, a sash member of the; and a frame co-operating member configured for coupling to the sash member;

wherein:

the frame member defines a planar surface and a retainer, wherein the retainer projects above the planar surface;

the sash member defines a sealing member receiver configured for coupling with a sealing member; and the frame member, the sash member, the frame co-operating member and the sealing member receiver are co-operatively configured such that, while the frame co-operating member is coupled to the sash member and the sealing member is coupled to the sash member via the sealing member receiver, and while the sash is slidable relative to the frame between a first position, wherein the sash member is disposed relative to the frame such that the retainer and the frame-cooperating member are disposed in alignment along an axis that extends transverse to a plane of a pane of glass that is supported by the sash such that the retainer interferes with movement of the sash member relative to the frame member in an inwardly direction by opposition to movement of the frame-cooperating member, and a second position, wherein the sash member is disposed relative to the frame such that there is an absence of interference to movement of the sash member, by the retainer, in the inwardly direction:

the frame co-operating member is disposed in contact engagement with the frame member such that the sash member is elevated above the planar surface by the frame co-operating member with effect that a gap is defined between the sash member and the frame member with effect that the sealing member is disposed in contact engagement between the frame co-operating member and the frame effective; and the sealing member is emplaced within the gap defined between the sash member and the frame member with effect that the sealing member is disposed in contact engagement with the planar surface; and while the sash is disposed relative to the frame in the first position, the interference to movement of the sash member relative to the frame member is such that:

movement of the sash relative to the frame in the inwardly direction by a first distance is effected by disposition of at least a portion of the frame co-operating member underneath at least portion of the retainer; and movement of the sash relative to the frame in the inwardly direction by a distance greater than the first distance is prevented, or substantially prevented, by interference between at least a portion of the frame co-operating member and the retainer such that opposition to movement of the sash frame co-operating member by a distance greater than the first distance is effected by the at least a portion of the retainable part acting against the retainer.

23. The kit as claimed in claim 22;

wherein:

the frame co-operating member includes a limiter for limiting movement of the sash relative to the frame in the inwardly direction to the first distance.

24. The kit as claimed in claim 22;

wherein:

the retainer includes a longitudinal protrusion projecting above the planar a surface of the frame member, the longitudinal protrusion defining an open end; and the frame co-operating member includes:

a protrusion portion; and a limiter; and wherein the frame member, the frame co-operating member and the sash member are co-operatively configured such that while the sash is disposed relative to the frame in the first position:

the movement of the sash relative to the frame in the inwardly direction by the first amount is such that the protrusion portion is disposed within the open end of the longitudinal protrusion; and the interference, between the frame co-operating member and the retainer, to movement of the sash by a distance greater than the first distance is effected by impingement of the limiter against a front edge of the longitudinal protrusion.

25. The kit as claimed in claim 24;

wherein:

the frame co-operating member further comprises a glider, wherein the glider is disposed in contact engagement with the planar surface of the frame member; and the protrusion portion, the limiter and the glider are cooperatively configured such that:

the limiter is disposed intermediate the protrusion portion and the glider.

26. The kit as claimed in claim 25;

wherein:

the frame member, the sash member and the frame co-operating member are cooperatively configured such that, while the frame co-operating member is coupled to the sash member and the sash is disposed within the frame in the first position:

the glider is disposed adjacent to the retainer along a longitudinal axis of the frame member in contact engagement with the planar surface; and the glider engages the frame such that sliding movement of the sash relative to the frame from the first position to the second position is effected, in part, by sliding movement of the glider along the planar surface of the frame member.

27. This kit as claimed in claim 22, wherein:

the sealing member includes weather stripping.

28. The kit as claimed in claim 22, wherein:

the contact engagement between the sealing member and the frame member is effective for establishing a weather-tight seal between the sash member and the frame member.

29. The kit as claimed in claim 22, wherein:

the sealing member receiver is a groove extending along the sash member.

30. A window assembly, comprising:

a frame; and a sash slidably mounted relative to the frame for slidable movement relative to the frame; and a frame co-operating member coupled to the sash member;

wherein:

the frame includes a frame member defining a planar surface and a retainer, wherein the retainer projects above the planar surface;

the sash includes a sash member, the sash member defining a sealing member receiver configured for coupling with a sealing member; and the frame, the sash, and the frame co-operating member are co-operatively configured such that, while a sealing member is coupled to the sash member via the sealing member receiver, and while the sash is slidable relative to the frame between a first position, wherein the sash member is disposed relative to the frame such that the retainer and the frame-cooperating member are disposed in alignment along an axis that extends transverse to a plane of a pane of glass that is supported by the sash such that the retainer interferes with deflection of the sash member relative to the frame member in an inwardly direction by opposition to movement of the frame-cooperating member, and a second position, wherein the sash member is disposed relative to the frame such that there is an absence of interference to movement of the sash member, by the retainer, in the inwardly direction:

the frame-cooperating member is disposed in contact engagement with the frame member such that the sash member is elevated above the planar surface by the frame-cooperating member with effect that a gap is defined between the sash member and the planar surface; and the sealing member is emplaced within the gap defined between the sash member and the frame member with effect that the sealing member is disposed in contact engagement with the planar surface.

31. The window assembly as claimed in claim 30, wherein:

the sealing member includes weather stripping.

32. The window assembly as claimed in claim 30, wherein:

the contact engagement between the sealing member and the frame member is effective for establishing a weather-tight seal between the sash member and the frame member.

33. A kit of parts configurable for assembly within a window assembly that defines a window opening, and includes a frame and a sash, wherein the sash is slidably mounted relative to the frame for slidable movement relative to the frame, wherein the kit comprises:

a frame member of the frame, a sash member of the sash; and a frame-cooperating member configured for coupling to the sash member;

wherein the frame member defines a planar surface and a retainer, wherein the retainer projects above the planar surface, the retainer having an end edge that defines an open end; and the frame member, the sash member, and the frame-cooperating member are co-operatively configured such that, while the frame co-operating member is coupled to the sash member and while the sash is disposed relative to the frame for sliding movement relative to the frame, the retainer and the frame-cooperating member are cooperatively configured such that:

while the sash is disposed relative to the frame in a first position, the retainer and the frame-cooperating member are disposed in alignment along an axis that extends transverse to a plane of a pane of glass that is supported by the sash such that the retainer interferes with deflection of the sash member relative to the frame member in an inwardly direction by opposition to movement of the frame-cooperating member, wherein the opposition to movement of the frame-cooperating member by the retainer includes impingement of the frame-cooperating member against the end edge of the retainer; and slidable movement of the sash relative to the frame that is effective to defeat the alignment of the frame-cooperating member with the retainer such that the sash is disposed relative to the frame in a second position, is with effect that there is an absence of interference to movement of the sash member in the inwardly direction by the retainer.

34. A kit of parts configurable for assembly within a window assembly that defines a window opening, and includes a frame and a sash, wherein the sash is slidably mounted relative to the frame for slidable movement relative to the frame, wherein the kit comprises:

a frame member of the frame, a sash member of the sash; and a frame-cooperating member configured for coupling to the sash member;

wherein the frame member defines a planar surface and a retainer, wherein the retainer projects above the planar surface at a midpoint of the frame member; and the frame member, the sash member, and the frame-cooperating member are co-operatively configured such that, while the frame co-operating member is coupled to the sash member and while the sash is disposed relative to the frame for sliding movement relative to the frame, the retainer and the frame-cooperating member are cooperatively configured such that:

while the sash is disposed relative to the frame in a first position, the retainer and the frame-cooperating member are disposed in alignment along an axis that extends transverse to a plane of a pane of glass that is supported by the sash such that the retainer interferes with deflection of the sash member relative to the frame member in an inwardly direction by opposition to movement of the frame-cooperating member, the opposition to movement of the frame-cooperating member by the retainer being effected proximate a midpoint of the sash member; and slidable movement of the sash relative to the frame, from the first position, that is effective to defeat the alignment of the frame-cooperating member with the retainer such that the sash is disposed relative to the frame in a second position is with effect that there is an absence of interference to movement of the sash member in the inwardly direction by the retainer.

* * * * *